US011940147B2

(12) United States Patent
Black et al.

(10) Patent No.: US 11,940,147 B2
(45) Date of Patent: Mar. 26, 2024

(54) BLOWN AIR HEATING SYSTEM

(71) Applicant: Brunswick Corporation, Mettawa, IL (US)

(72) Inventors: Stuart C. Black, Ballyclare (IE); David M. Hopley, Bangor (IE); Philip Eadie, Donaghadee (IE)

(73) Assignee: Brunswick Corporation, Mettawa, IL (US)

( * ) Notice: Subject to any disclaimer, the term of this patent is extended or adjusted under 35 U.S.C. 154(b) by 20 days.

(21) Appl. No.: 17/836,158

(22) Filed: Jun. 9, 2022

(65) Prior Publication Data

US 2023/0408084 A1 Dec. 21, 2023

(51) Int. Cl.
*F23D 14/06* (2006.01)
*F23D 14/66* (2006.01)
*F23L 5/02* (2006.01)

(52) U.S. Cl.
CPC ..... *F23D 14/06* (2013.01); *F23D 14/66* (2013.01); *F23L 5/02* (2013.01)

(58) Field of Classification Search
CPC ..... F23D 14/06; F23D 14/66; F23L 5/02
USPC ..... 431/354; 126/401–414
See application file for complete search history.

(56) References Cited

U.S. PATENT DOCUMENTS 2,260,062 A 10/1941 Stillman
3,671,150 A 6/1972 Jackson et al.
4,086,048 A 4/1978 Carlson
4,244,349 A 1/1981 Velie et al.
4,474,534 A 10/1984 Thode
4,477,245 A 10/1984 Giachino et al.
4,519,375 A * 5/1985 Galtz ..... F24H 3/065 126/110 B
4,712,996 A 12/1987 Adams et al.
(Continued)

FOREIGN PATENT DOCUMENTS

CA 2188616 C 1/2001
DE 3144787 C1 8/1983
(Continued)

OTHER PUBLICATIONS

Ewald et al., "Noise Reduction by Applying Modulation Principles," The University of Wisconsin, Department of Mechanical Engineering, Madison, Wisconsin 53705, The Journal of the Acoustical Society of America, Received Nov. 23, 1970, pp. 1381-1385.
(Continued)

*Primary Examiner* — Vivek K Shirsat
(74) *Attorney, Agent, or Firm* — Andrus Intellectual Property Law, LLP

(57) ABSTRACT

A blown air heating system has a housing having an upstream air inlet and a downstream air outlet and a forced-air device configured to draw air into the housing via the air inlet and force the air out of the housing via the air outlet, wherein the air follows an airflow path from the air inlet to the air outlet. A gas burner is configured to heat the air as it passes through the housing. A gas valve is configured to provide a fuel gas to the gas burner, and the gas valve is located between the air inlet and the air outlet and in the airflow path. A baffle is in the airflow path, and the baffle is configured to divert the flow of air away from at least part of the gas valve.

20 Claims, 8 Drawing Sheets
(2 of 8 Drawing Sheet(s) Filed in Color)

(56) References Cited

U.S. PATENT DOCUMENTS

| | | | |
|---|---|---|---|
| 5,062,790 | A | 11/1991 | Loberger et al. |
| 5,232,153 | A | 8/1993 | Mohring et al. |
| 5,335,841 | A | 8/1994 | Yamanashi |
| 5,355,841 | A | 10/1994 | Moore, Jr. et al. |
| 5,682,826 | A | 11/1997 | Hollenbeck |
| 5,865,616 | A | 2/1999 | George |
| 5,931,660 | A | 8/1999 | Amrhein et al. |
| 5,984,664 | A | 11/1999 | Sutton |
| 6,889,685 | B2 | 5/2005 | Dane |
| 7,131,462 | B1 | 11/2006 | Chen |
| 7,223,094 | B2 | 5/2007 | Goebel |
| 8,075,304 | B2 | 12/2011 | Cox et al. |
| 8,408,897 | B2 | 4/2013 | Rossi et al. |
| 9,046,108 | B2 | 6/2015 | Duke et al. |
| 9,206,986 | B2 | 12/2015 | Jeong et al. |
| 10,718,518 | B2 | 7/2020 | Eadie et al. |
| 2002/0086254 | A1 | 7/2002 | Chen |
| 2004/0038167 | A1 | 2/2004 | Han |
| 2006/0051718 | A1 | 3/2006 | Kamal et al. |
| 2006/0199123 | A1 | 9/2006 | Seguin et al. |
| 2008/0266120 | A1 | 10/2008 | Leeland et al. |
| 2009/0211540 | A1 | 8/2009 | Yin et al. |
| 2010/0112500 | A1 | 5/2010 | Maiello et al. |
| 2011/0052385 | A1 | 3/2011 | Duke |
| 2014/0209086 | A1 | 7/2014 | Potter et al. |
| 2015/0081086 | A1 | 3/2015 | Hallowell et al. |
| 2015/0276221 | A1 | 10/2015 | Abate et al. |
| 2016/0047547 | A1 | 2/2016 | Barels |
| 2016/0138799 | A1 | 5/2016 | Colannino et al. |
| 2016/0281984 | A1 | 9/2016 | Munsterhuis et al. |
| 2016/0363316 | A1 | 12/2016 | Park et al. |
| 2017/0030581 | A1 | 2/2017 | Li et al. |
| 2019/0162408 | A1 | 5/2019 | Eadie et al. |
| 2020/0025368 | A1* | 1/2020 | Black ..... F23D 14/66 |

FOREIGN PATENT DOCUMENTS

| | | | |
|---|---|---|---|
| DE | 3604314 | C2 | 5/1991 |
| DE | 10300602 | A1 | 7/2003 |
| DE | 10220774 | A1 | 11/2003 |
| DE | 102020008001 | A1 | 10/2021 |
| EP | 0770824 | A2 | 1/2000 |
| EP | 1207340 | A2 | 5/2002 |
| EP | 1650502 | A2 | 4/2006 |
| EP | 2278224 | A2 | 1/2011 |
| EP | 2871415 | A1 | 5/2015 |
| EP | 3124866 | A1 | 2/2017 |
| EP | 3156729 | A2 | 4/2017 |
| EP | 3869098 | A1 | 8/2021 |
| JP | 59131826 | A | 7/1984 |
| WO | 2010094673 | A1 | 8/2010 |
| WO | 2017085680 | A1 | 5/2017 |

OTHER PUBLICATIONS

Black et al., "Gas Burner," Unpublished U.S. Appl. No. 17/836,151, filed Jun. 9, 2022 (drawings, specification, and claims only).

Hunniford et al., "Gas Burner Systems and Methods for Calibrating Gas Burner Systems," U.S. Appl. No. 17/109,339, filed Dec. 2, 2020 (specification, claims and drawings only).

* cited by examiner

BLOWN AIR HEATING SYSTEM

FIELD

The present disclosure relates to blown air heating systems, for example, blown air heating systems that rely on gas burners for heating air to be supplied to an area to be heated.

BACKGROUND

U.S. Pat. No. 10,718,518 discloses a gas burner system having a gas burner with a conduit through which an air-gas mixture is conducted; a variable-speed forced-air device that forces air through the conduit; a control valve that controls a supply of gas for mixture with the air to thereby form the air-gas mixture; and an electrode configured to ignite the air-gas mixture so as to produce a flame. The electrode is further configured to measure a flame ionization current associated with the flame. A controller is configured to actively control the variable-speed forced-air device based on the flame ionization current measured by the electrode so as to automatically avoid a flame harmonic mode of the gas burner. Corresponding methods are provided.

U.S. Patent Application Publication No. 2020/0025368 discloses a forced-draft pre-mix burner device having a housing that conveys air from an upstream cool air inlet to a downstream warm air outlet. A heat exchanger warms the air prior to discharge via the warm air outlet. A gas burner burns an air-gas mixture to thereby warm the heat exchanger. A fan mixes the air-gas mixture and forces the air-gas mixture into the gas burner. The fan has a plurality of blades having sinusoidal-modulated blade spacing.

U.S. patent application Ser. No. 17/109,339, filed Dec. 2, 2020, discloses a gas burner system including a gas burner through which an air-gas mixture is conducted; a variable-speed forced-air device that forces air through the gas burner; a control valve that controls a supply of gas for mixture with the air to thereby form the air-gas mixture; an electrode configured to ignite the air-gas mixture and produce a flame, wherein the electrode is further configured to measure an actual flame strength of the flame; a controller; and an input device for inputting a calibration command to the controller. Upon receipt of the calibration command, the controller is configured to automatically calibrate and save the target flame strength set point and thereafter automatically regulate a speed of the variable-speed forced-air device to cause the actual flame strength to achieve the target flame strength set point. Corresponding methods are provided.

The above patents and applications are hereby incorporated by reference herein in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a blown air heating system comprises a housing having an upstream air inlet and a downstream air outlet and a forced-air device configured to draw air into the housing via the air inlet and force the air out of the housing via the air outlet, wherein the air follows an airflow path from the air inlet to the air outlet. A gas burner is configured to heat the air as it passes through the housing. A gas valve is configured to provide a fuel gas to the gas burner, and the gas valve is located between the air inlet and the air outlet and in the airflow path. A baffle is in the airflow path, and the baffle is configured to divert the flow of air away from at least part of the gas valve.

According to one example, the housing has a longitudinal axis that extends through the air inlet and the air outlet. The baffle extends along a majority of a width of the gas valve, the width being defined along a transverse axis perpendicular to the longitudinal axis.

According to one example, the blown air heating system further comprises a motor that powers the forced-air device. An output shaft of the motor is coaxial with a longitudinal axis of the housing that extends through the air inlet and the air outlet. The gas valve is located directly adjacent the motor.

According to one example, the forced-air device comprises a plurality of blades. The gas valve is located within a projection along the longitudinal axis of a circle circumscribing the plurality of blades.

According to another example of the present disclosure, a blown air heating system comprises a housing having an upstream air inlet and a downstream air outlet, the housing having a longitudinal axis that extends through the air inlet and the air outlet. A forced-air device has a plurality of blades and is configured to draw air into the housing via the air inlet and force the air out of the housing via the air outlet, wherein the air follows an airflow path from the air inlet to the air outlet. A gas burner is configured to heat the air as it passes through the housing. A gas valve is configured to provide a fuel gas to the gas burner, and the gas valve is located within a projection along the longitudinal axis of a circle circumscribing the plurality of blades of the forced-air device. A baffle is in the airflow path and the baffle is configured to divert the flow of air away from at least part of the gas valve.

According to another example of the present disclosure, a blown air heating system comprises a housing having an upstream air inlet and a downstream air outlet, the housing having a longitudinal axis that extends through the air inlet and the air outlet. A forced-air device is configured to draw air into the housing via the air inlet and force the air out of the housing via the air outlet, wherein the air follows an airflow path from the air inlet to the air outlet. A motor powers the forced-air device, and an output shaft of the motor is coaxial with the longitudinal axis of the housing. A gas burner is aligned along the longitudinal axis of the housing and configured to heat the air as it passes through the housing. A gas valve is configured to provide a fuel gas to the gas burner, and the gas valve is located directly adjacent the motor. A baffle is in the airflow path, and the baffle is configured to divert the flow of air away from at least part of the gas valve.

In any of the above examples, the blown air heating system may further comprise a cover provided over a majority of the gas valve.

In any of the above examples the cover may be located at least on an upstream side of the gas valve.

In any of the above examples, the baffle may extend from the cover.

In any of the above examples, the baffle may extend from the cover proximate the upstream side of the gas valve and the part of the gas valve is located downstream of the baffle.

In any of the above examples, the baffle extends from a first end proximate the gas valve to a second end proximate an inside surface of the housing.

In any of the above examples, the baffle extends from a first end proximate the gas valve and curves toward a second end that is located upstream of the first end.

In any of the above examples, the part of the gas valve is an inlet port of the gas valve that is configured to be coupled to a gas supply conduit supplying the fuel gas.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Examples of gas burners and associated blown air heating systems are described with reference to the following Figures. The same numbers are used throughout the Figures to reference like features and like components.

DETAILED DESCRIPTION

Figure 1:
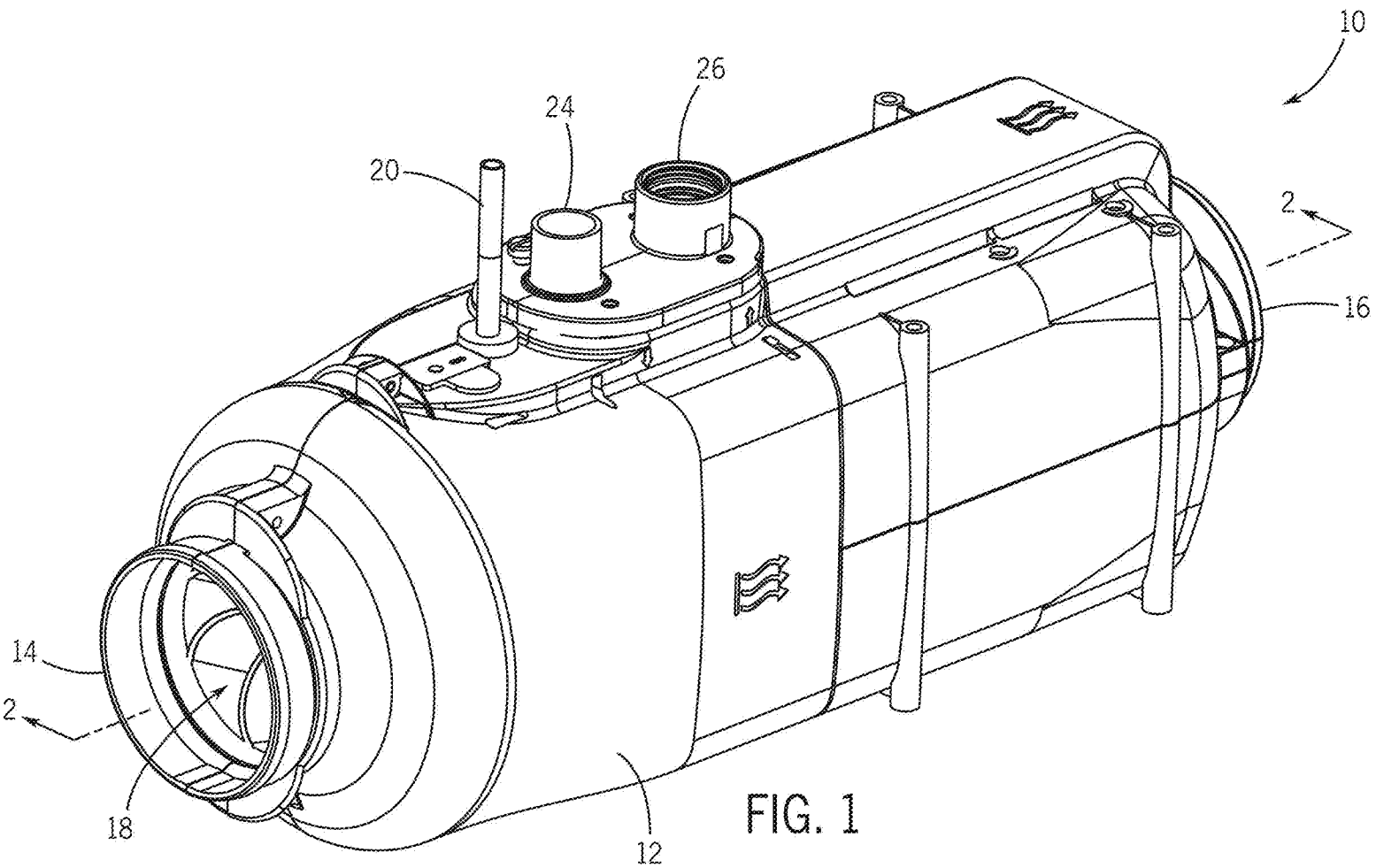
FIG. 1 illustrates a blown air heating system according to the present disclosure.

Before any embodiments of the invention are explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C. Likewise, unless otherwise specified or limited, the terms "mounted," "connected," "linked," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "bottom," "front," "back," "left," "right," "lateral" or "longitudinal" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements from another.

Figure 2:
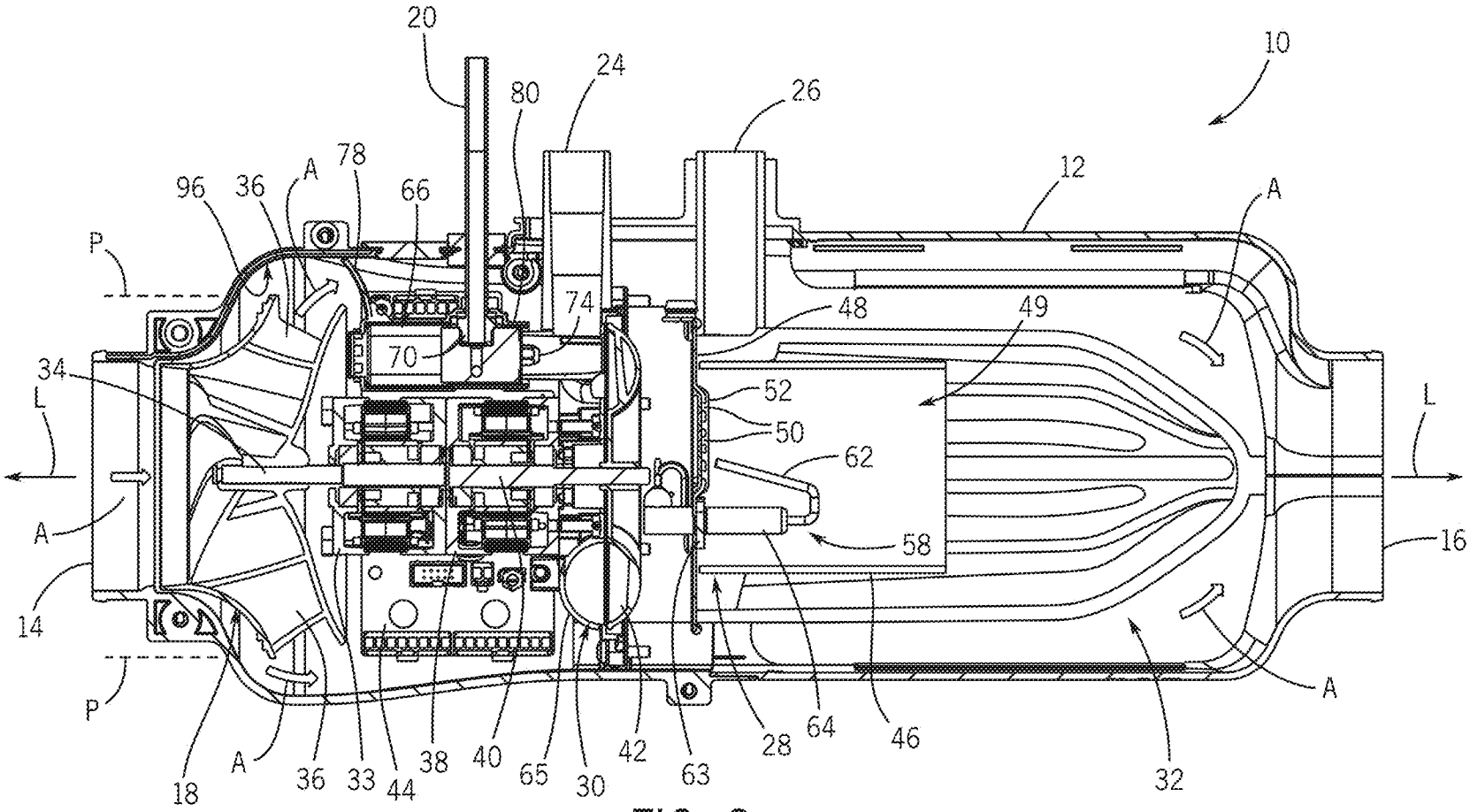
FIG. 2 is a cross section of the blown-air heating system of FIG. 1, taken along the line 2-2 in FIG. 1.

FIGS. 1 and 2 depict an exemplary blown air heating system 10 according to the present disclosure. The blown air heating system 10 as shown is in the form of an underfloor or onboard space heater for installation in a recreational vehicle (RV), but could be any other type of blown air heating system. The blown air heating system 10 includes a housing 12 (e.g., made of plastic) having an upstream air inlet 14 and a downstream air outlet 16. The housing 24 has a longitudinal axis L that extends through the air inlet 14 and the air outlet 16. A forced-air device 18 is configured to draw air into the housing 12 via the air inlet 14 and force the air out of the housing 12 via the air outlet 16. A gas burner 28 is configured to heat the air as it passes through the housing 12. Fuel gas from a fuel gas source (such as a tank, not shown) is provided to the gas burner 28 via gas supply conduit 20 extending through the housing 12. A second forced-air device 30 draws air through a combustion intake port 24 extending through the housing 12. The air for combustion is mixed with the fuel gas in the forced-air device 30 and provided to the gas burner 28, after which it flows through a heat exchanger 32 provided in the housing 12 and out of a combustion exhaust port 26 extending through the housing 12. The heat exchanger 32 is arranged concentrically with a burner tube 46 of the gas burner 28 and transfers heat from the relatively hotter combustion air to the relatively cooler circulating air flowing from the air inlet 14 to the air outlet 16, which circulating air is forced across the heat exchanger 32 by the forced-air device 18. Thus, the upstream air inlet 14 receives relatively cooler air and the downstream air outlet 16 discharges relatively warmer air for provision to an area to be heated.

A first motor 33 powers the forced-air device 18. Specifically, an output shaft 34 of the motor 33, which is coaxial with the longitudinal axis L of the housing 12, is connected to a hub of the forced-air device 18. The forced-air device 18 comprises a plurality of blades (see, e.g., blades 36) extending from the hub and rotatable by the output shaft 34 of the motor 33 thereby to draw air into the housing 12 via the air inlet 14 and force air out of the housing 12 via the air outlet 16. In the example shown, the forced-air device 18 is a fan, but it could be a blower.

A second motor 38 powers the forced-air device 30. Specifically, an output shaft 40 of the motor 38, which is coaxial with the longitudinal axis L of the housing 12, is connected to a hub of the forced-air device 30. The forced-air device 30 comprises a plurality of blades (see, e.g., blade 42) extending from the hub and rotatable by the output shaft 40 of the motor 38 thereby to draw combustion air into the housing 12 via the combustion intake port 24 and force air out of the housing 12 via the combustion exhaust port 26. In the example shown, the forced-air device 30 is a blower, but it could be a fan.

Both of the motors 33, 38 can be, for example, brushless DC motors. Both motors 33, 38 can be variable speed, so as to vary the rotational speed of the forced-air devices 18, 30 and thus the amount of circulating air passing through the housing 12 for provision into the area to be heated and/or the amount of combustion air passing thorough the gas burner 28. The motors 33, 38 can be controlled by a controller, which may be provided on a circuit board 44 located in the housing 12. In one example, the same controller controls both motors 33, 38. Alternatively, separate controllers, provided on the same circuit board or separate circuit boards, can control each respective motor 33, 38.

Operation of the blown air heating system 10 as described thus far hereinabove is the same as that described in U.S. Pat. No. 10,718,518, incorporated by reference.

Figure 3:
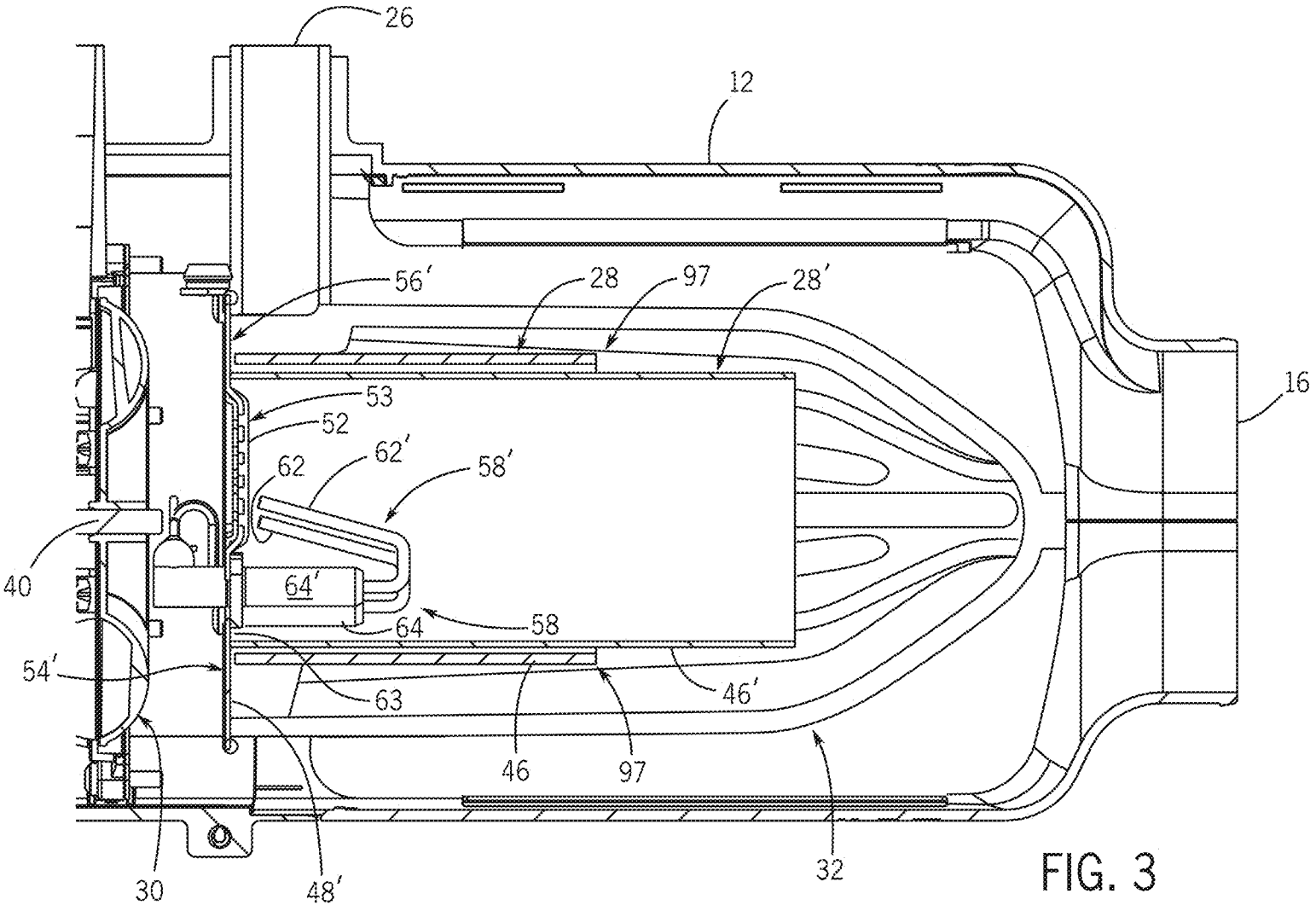
FIG. 3 is a cross section like that of FIG. 2, but zoomed in on two alternative gas burners for use in the blown air heating system.

FIG. 3 illustrates a zoomed-in view of a portion of the blown air heating system 10, including the gas burner 28 as shown in FIG. 2. FIG. 3 also shows an alternative gas burner 28' according to the present disclosure. It should be understood that the gas burners 28, 28' are not used together in the same blown air heating system 10, but are superimposed here for purposes of comparison and contrast with one another as will be detailed herein below.

Figure 4:
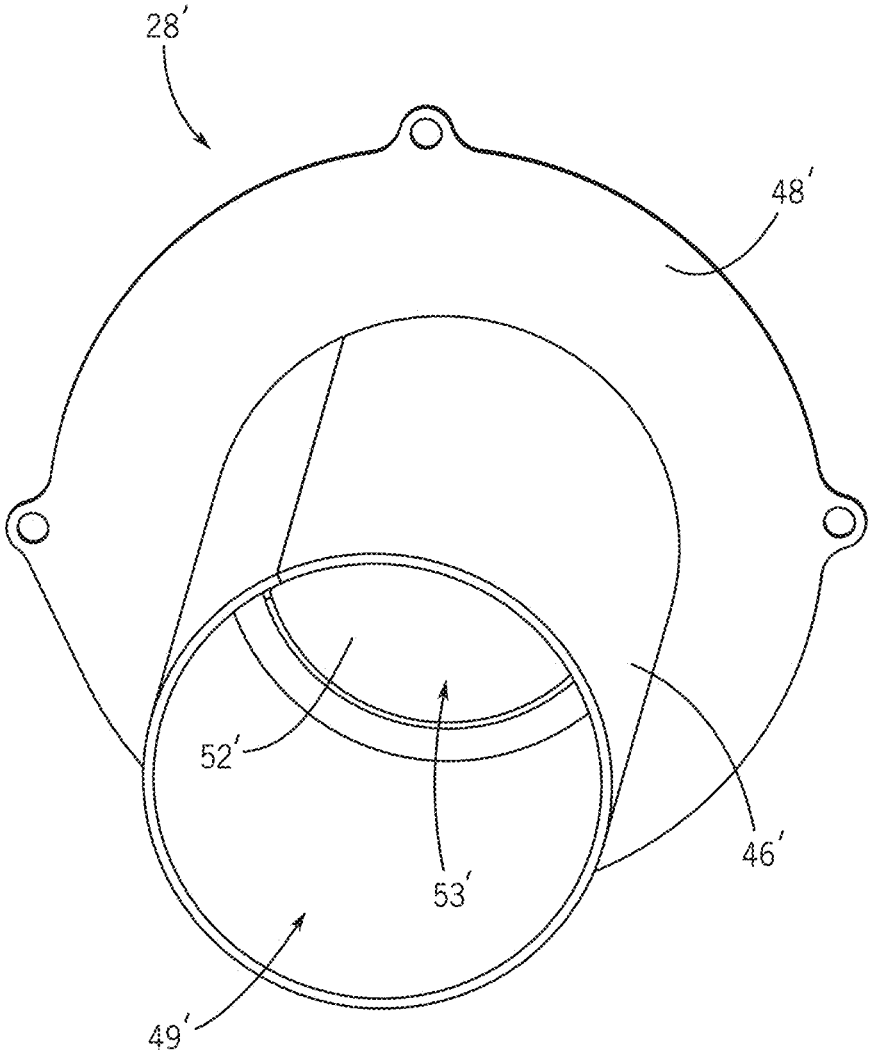
FIG. 4 is a perspective view of an exemplary gas burner according to the present disclosure.
Figure 5:
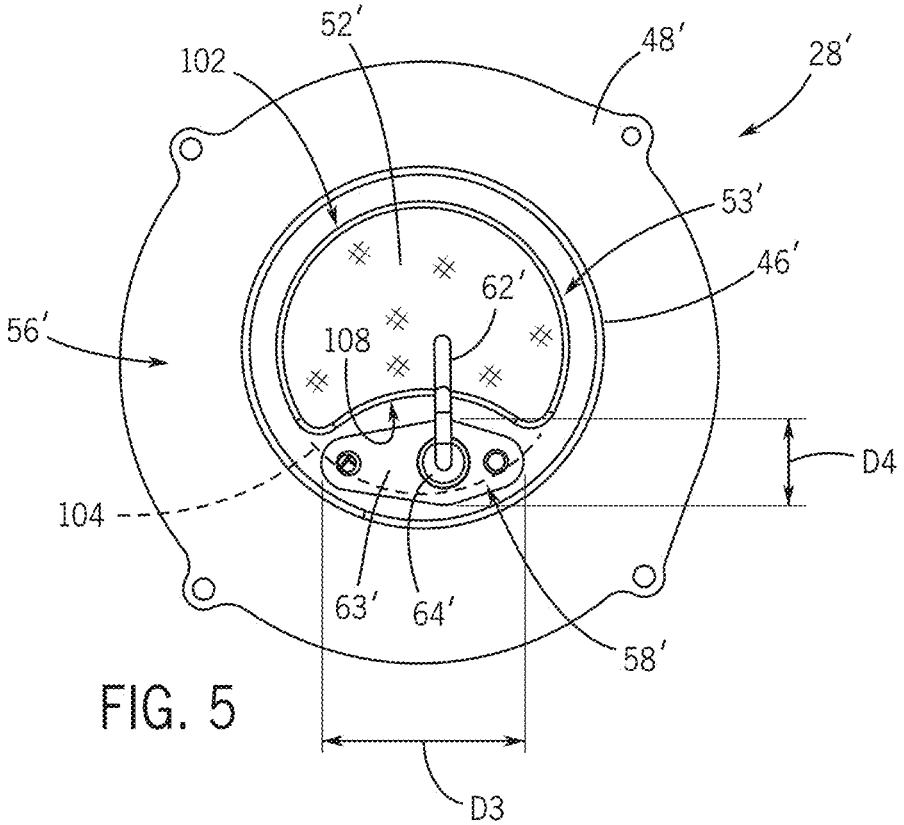
FIG. 5 is a view looking down a burner tube of the gas burner of FIG. 4, as seen from the downstream side thereof.
Figure 6:
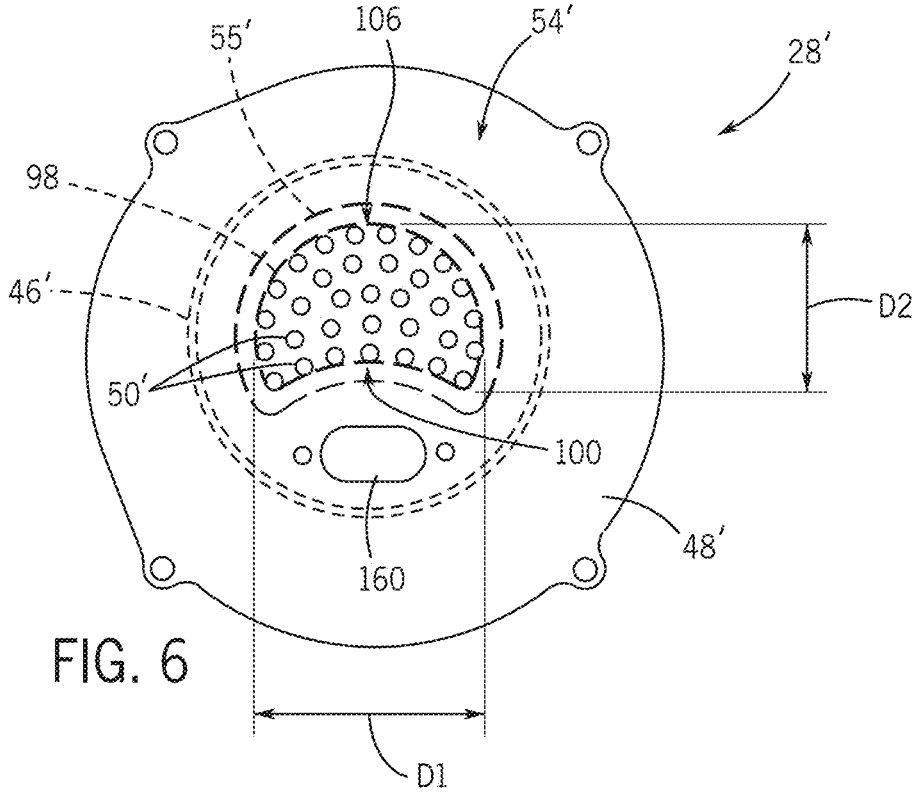
FIG. 6 is a view from the opposite upstream side of the gas burner.
Figure 7:
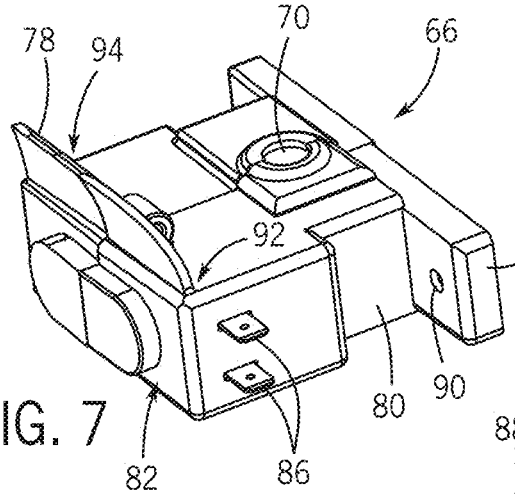
FIGS. 7-9 are perspective views of an exemplary gas valve for use in the blown air heating system of FIG. 1.
Figure 8:
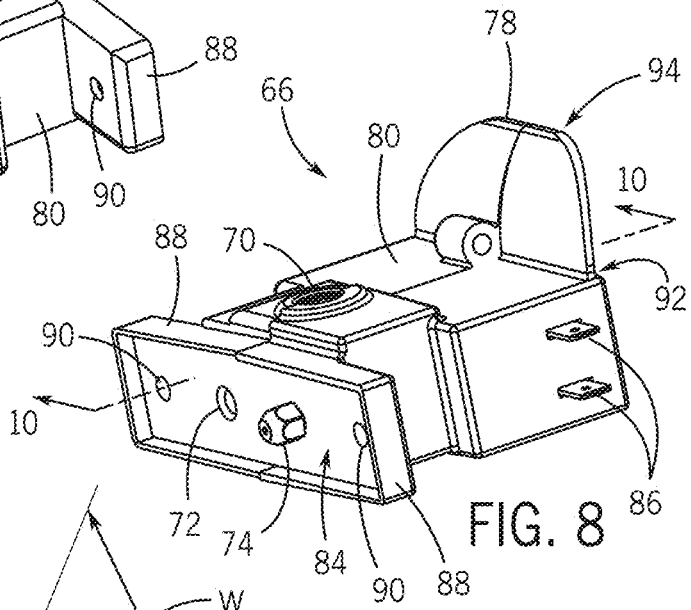
Figure 9:
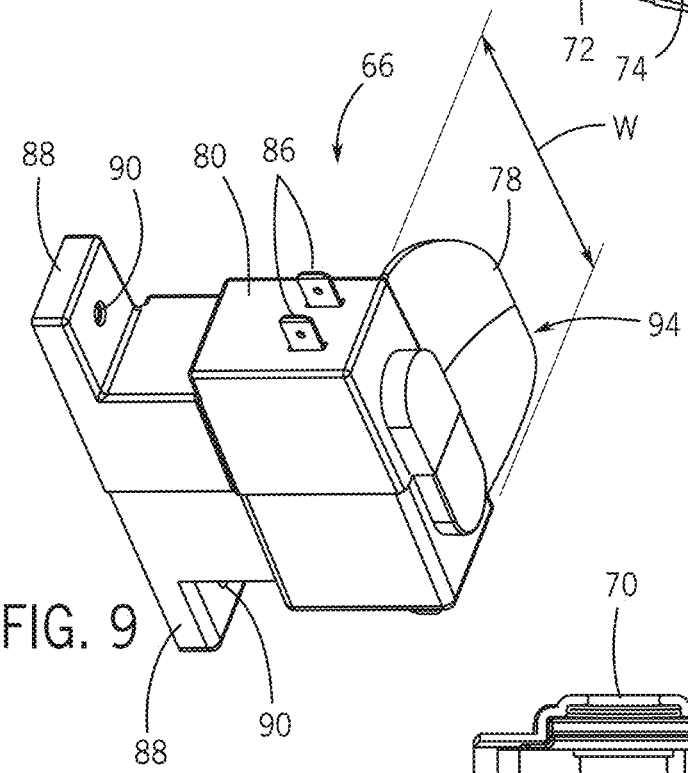

FIGS. 4-6 depict the exemplary gas burner 28' according to the present disclosure in isolation. FIG. 4 shows the gas burner 28' in perspective, FIG. 5 shows the gas burner 28' from a first downstream side, and FIG. 6 shows the gas burner 28' from an second upstream side. The gas burner 28' has an elongated metal burner tube 46' that defines a conduit 49' into which a fully pre-mixed air-gas mixture is conveyed from the forced-air device 30 for combustion. A metal burner deck 48' is disposed on one end of the burner tube 46'. The burner deck 48' has a plurality of ports 50' located within an indented portion 55' of the burner deck 48' (FIG. 6) through which the air-gas mixture is caused to flow, as will be further explained herein below. In the present example, the plurality of ports 50' includes a total of thirty-three ports, each port having a diameter of 3.6 millimeters. Together, the plurality of ports 50' provides an open area of 20.5% of the portion of the burner deck 48' inside the conduit 49'. No secondary air is introduced into the gas burner 28' (i.e., the only air introduced into the gas burner 28' is that delivered from the forced-air device 30).

As shown in FIGS. 3, 5, and 6, the burner deck 48' has a first (upstream) face 54' and an opposite second (downstream) face 56', and the plurality of ports 50' extend from the first face 54' to the second face 56'. A burner skin 52' is coupled to the second face 56' of the burner deck 48' and covers the plurality of ports 50'. Together, the indented portion 55' of the burner deck 48' and the burner skin 52' constitute a burner head 53'. In the illustrated example, the burner skin 52' is made of woven metal matting; however the type and configuration of burner skin can vary from what is shown. The burner skin 52' is configured to distribute the air-gas mixture from the plurality of ports 50' and thus facilitate a consistent and evenly distributed burner flame inside the burner tube 46'. The flame is started by an igniter 58', part of which igniter 58' is located on the second face 56' of the burner deck 48' adjacent the burner skin 52'. As shown in FIG. 3, part of the igniter 58' is also located on the first face 54' of the burner deck 48'. The burner tube 46' extends from the second face 56' of the burner deck 48' and surrounds the plurality of ports 50', the burner skin 52', and the part of the igniter 58' that is on the second face 56' of the burner deck 48'.

The igniter 58', which includes an ignition and flame sensing electrode 62', is disposed in the burner tube 46', proximate to the burner skin 52'. The igniter 58' extends through an aperture 60' (FIG. 6) in the burner deck 48' and is fastened to the burner deck 48' via a connecting flange 63'. The type of igniter 58' and the manner in which the igniter 58' is coupled to the gas burner 28' can vary from what is shown. The igniter 58' can be a conventional item, for example a Rauschert electrode, Part No. P-17-0044-05. The igniter 58' has the above-noted electrode 62', a body 64' (e.g., made of ceramic) holding the electrode 62', and the noted flange 63' connecting the body 64' to the second face 56' of the burner deck 48'. The tip of the electrode 62' is oriented towards the burner skin 52', and the igniter 58' is configured to ignite the air-gas mixture in a conventional manner, as the air-gas mixture passes through the conduit 49' via the plurality of ports 50'. The resulting burner flame is thereafter maintained as the air-gas mixture flows through the burner skin 52'.

As noted, FIG. 3 also shows the gas burner 28 of FIG. 2. With the exception of the differences noted herein below, the gas burner 28 is configured generally the same as the gas burner 28' and includes a burner deck 48, a burner tube 46 defining conduit 49, a burner skin 52, a plurality of ports 50 through the burner deck 48 that are covered by the burner skin 52, and an igniter 58 (including flange 63, body 64, and electrode 62). Parts of the gas burner 28 that are not described specifically as being different from those of gas burner 28' function the same as correspondingly numbered parts of the gas burner 28' having a prime after the reference number therefor.

Still referring to FIG. 2, which description also applies to FIG. 3, the heat exchanger 32 has, for example, a cast aluminum body with a plurality of heat radiating fins. The gas burner 28, 28' extends into the body of the heat exchanger 32 so that the heat generated by the gas burner 28, 28' heats the heat exchanger 32. A noted hereinabove, air having been warmed by the gas burner 28, 28' is discharged from the burner tube 46, 46' to the interior of the heat exchanger 32 and then exits the housing 12 via the combustion exhaust port 26. A combustion chamber endcap 65 encloses the forced-air device 30 with respect to the heat exchanger 32 and thus separates the flow of combustion air with respect to the circulating air being heated by the heat exchanger 32 and exiting the housing 12 via the air outlet 16.

As shown in FIG. 2, the blown air heating system 10 also includes a supply (via gas supply conduit 20) of a fuel gas that is combustible, such as liquid propane gas (LPG), and a gas valve 66 that is configured to provide the fuel gas to the gas burner 28. The gas valve 66 is mounted on the combustion chamber endcap 65 by way of threaded fasteners or other known fastening mechanisms. As will be further described herein below with reference to FIGS. 7-10, the gas valve 66 includes solenoid valves, each of which are movable into fully closed positions preventing flow of fuel gas and alternately into wide open positions allowing flow of fuel gas. In use, the variable-speed forced-air device 30 is configured to force a mixture of air from a supply of ambient air (via combustion intake port 24) and combustible gas from the supply of fuel gas (via gas supply conduit 20 and gas valve 66) through the plurality of ports 50 in the burner deck 48 and into the conduit 49. It will thus be understood by those having ordinary skill in the art that the blown air heating system 10 is a "fully premix" blown air heating system in which all the gas (e.g., LPG) introduced into the conduit 49 is introduced via the gas valve 66, and all the air introduced into the conduit 49 is introduced via the variable-speed forced-air device 30. The air and gas are mixed together to form the above-mentioned air-gas mixture, which is ignited by the igniter 58 in the conduit 49.

The supply of fuel gas is controlled by the gas valve 66, and as such the blown air heating system 10 has discrete settings for heat input. An example of a suitable gas valve 66 is shown in FIGS. 7-10. In this non-limiting example, the gas valve 66 has a valve body 68 (FIG. 10) with an gas inlet port 70 configured to be coupled to the gas supply conduit 20 supplying the fuel gas and a pair of outlet ports 72, 74 which, in parallel, discharge the gas for combustion in the gas burner 28. A pair of conventional solenoid valves, one of which is shown at 76, are connected to the valve body 68 and configured to independently control discharge of the gas via the pair of outlet ports 72, 74, respectively. That is, each solenoid valve is connected to a respective one of the outlet ports 72, 74 and configured to fully open and fully close to thereby control the flow of gas therethrough. Each of the solenoid valves is electrically coupled to a power supply (e.g., at prongs 86) and configured such that a controller (which may be the same as or different from the above-mentioned controller on circuit board 44) can selectively cause the solenoid valves to independently open and/or close.

The controller is configured to receive an input (e.g., a power setting selection) from an operator via an operator input device such as a switch or button. In response to the input, the controller is further configured to send a control signal to the forced-air device 30 to thereby modify (turn on or increase) the speed of the forced-air device 30. The controller is further configured to send a control signal to the gas valve 66 to cause one or both of the solenoid valves in the gas valve 66 to open and thus provide a supply of gas. The controller is further configured to cause the electrode 62 of the igniter 58 to spark and thus create the burner flame.

Returning to FIG. 2, air that is drawn into the housing 12 via the air inlet 14 follows an airflow path from the air inlet 14 to the air outlet 16. Portions of this airflow path are shown by the arrows labeled A, it being understood that the airflow path of circulating air to be provided from the air outlet 16 to an area to be heated is generally through the entire housing 12 except where combustion air flows (i.e., except in the forced-air device 30, the gas burner 28, and the heat exchanger 32). As noted, the gas valve 66 is coupled to the combustion chamber endcap 65, which combustion chamber endcap 65 separates this flow of circulating air to be provided from the air outlet 16 to the area to be heated from the flow of combustion air. In the present example, the gas valve 66 is located between the air inlet 14 and the air outlet 16 and in the airflow path A. However, consensus standards for blown air heating systems require that gas piping and gas controls not be located within circulating air passageways in case of a leak in the gas path, which might cause LPG to be provided with the flow of heated air to a living space. The present inventors have discovered, through research and development, that a baffle 78 can be provided in the airflow path A, which baffle 78 the present inventors have specifically configured to divert the flow of air away from at least part of the gas valve 66. In fact, the present inventors have provided a cover 80 over a majority of the gas valve 66, as will be described now.

FIGS. 7-10 show the gas valve 66 with the cover 80 and baffle 78, and FIG. 2 may be referred to for orientation purposes. As shown, the cover 80 is located at least on an upstream side 82 of the gas valve 66, with respect to the direction of airflow A. In fact, the cover 80 covers the entire gas valve 66, including the valve body 68 and solenoid valves, except the downstream side 84, which interfaces with the combustion chamber endcap 65 to provide gas from the outlet ports 72, 74 to the forced-air device 30. Further, the cover 80 includes apertures for connection of the solenoid valves to power via prongs 86 extending through the apertures in the cover 80. The cover 80 includes flanges 88 at the downstream side 84 of the gas valve 66 that can be attached to the combustion chamber endcap 65 via threaded fasteners extending through holes 90 in the flanges 88. The baffle 78 extends from the cover 80 proximate the upstream side 82 of the gas valve 66, and the part of the gas valve 66 away from which the baffle 76 is configured to divert air is located downstream of the baffle 78. In the present example, the part of the gas valve 66 away from which the baffle 78 is configured to divert air is the gas inlet port 70 of the gas valve 66 that is configured to be coupled to the gas supply conduit 20 supplying the fuel gas. This is the location where a leak of LPG, if any, is most likely to occur.

Referring also to FIG. 2, the baffle 78 extends from a first end 92 proximate the gas valve 66 to a second end 94 proximate an inside surface 96 of the housing 12. This prevents air from simply flowing over the second end 94 of the baffle 78 and around the gas inlet port 70. Width-wise, the baffle 78 extends along a majority of a width W (FIG. 9) of the gas valve 66, the width W being defined along a transverse axis perpendicular to the longitudinal axis L of the blown air heating system 10. The present inventors have used computational fluid dynamics (CFD) analysis software to shown that a baffle 78 having such height and width dimensions significantly decreases airflow around the location of the gas inlet port 70.

Figure 10:
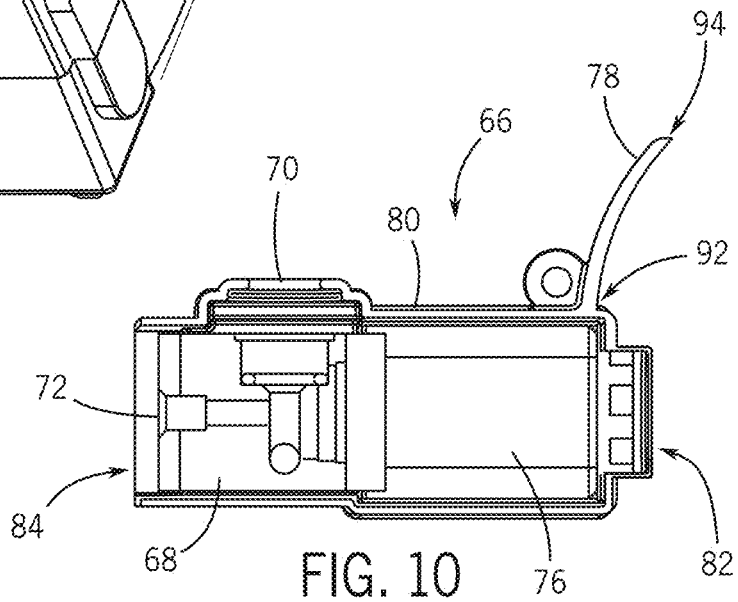
FIG. 10 is a cross section of the gas valve, taken along the line 10-10 in FIG. 8.
Figure 11:
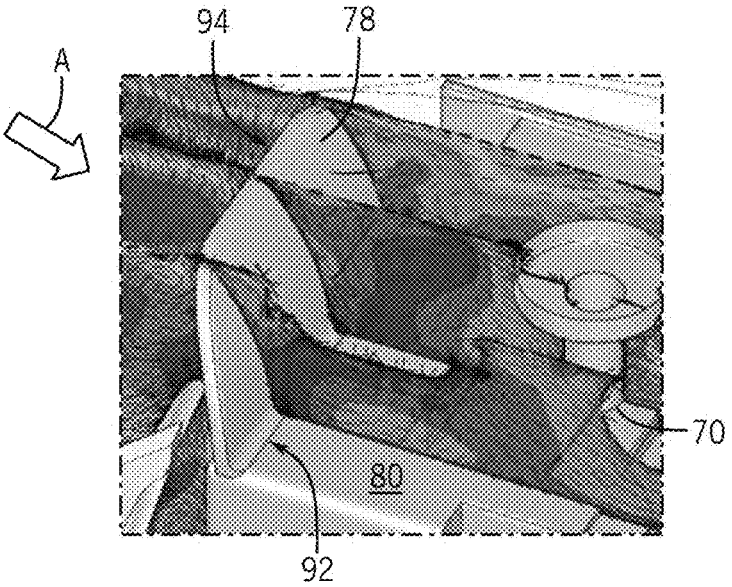
FIG. 11 is a perspective view of the gas valve and a baffle associated therewith as modeled using computational fluid dynamics (CFD) analysis software.
Figure 12:
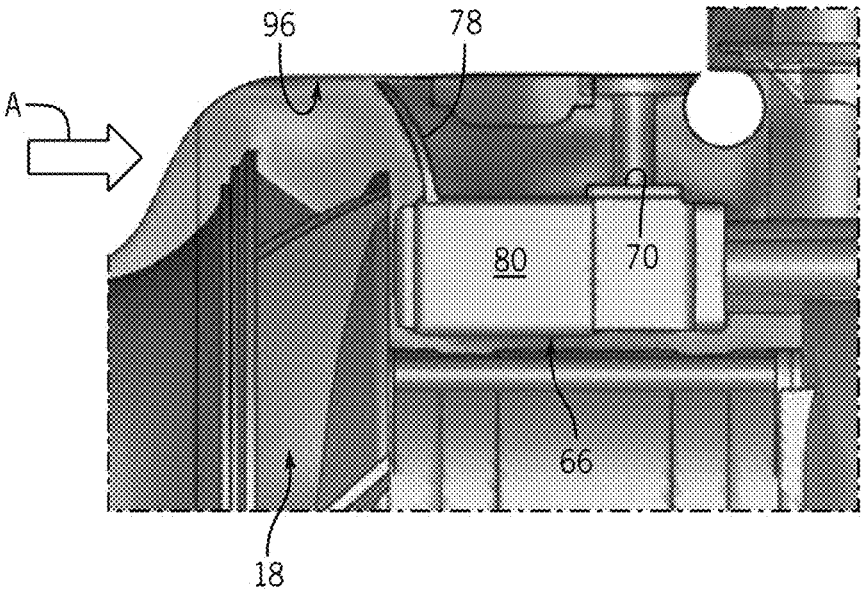
FIG. 12 is a side view of the gas valve and baffle as modeled using CFD analysis software.
Figure 13:
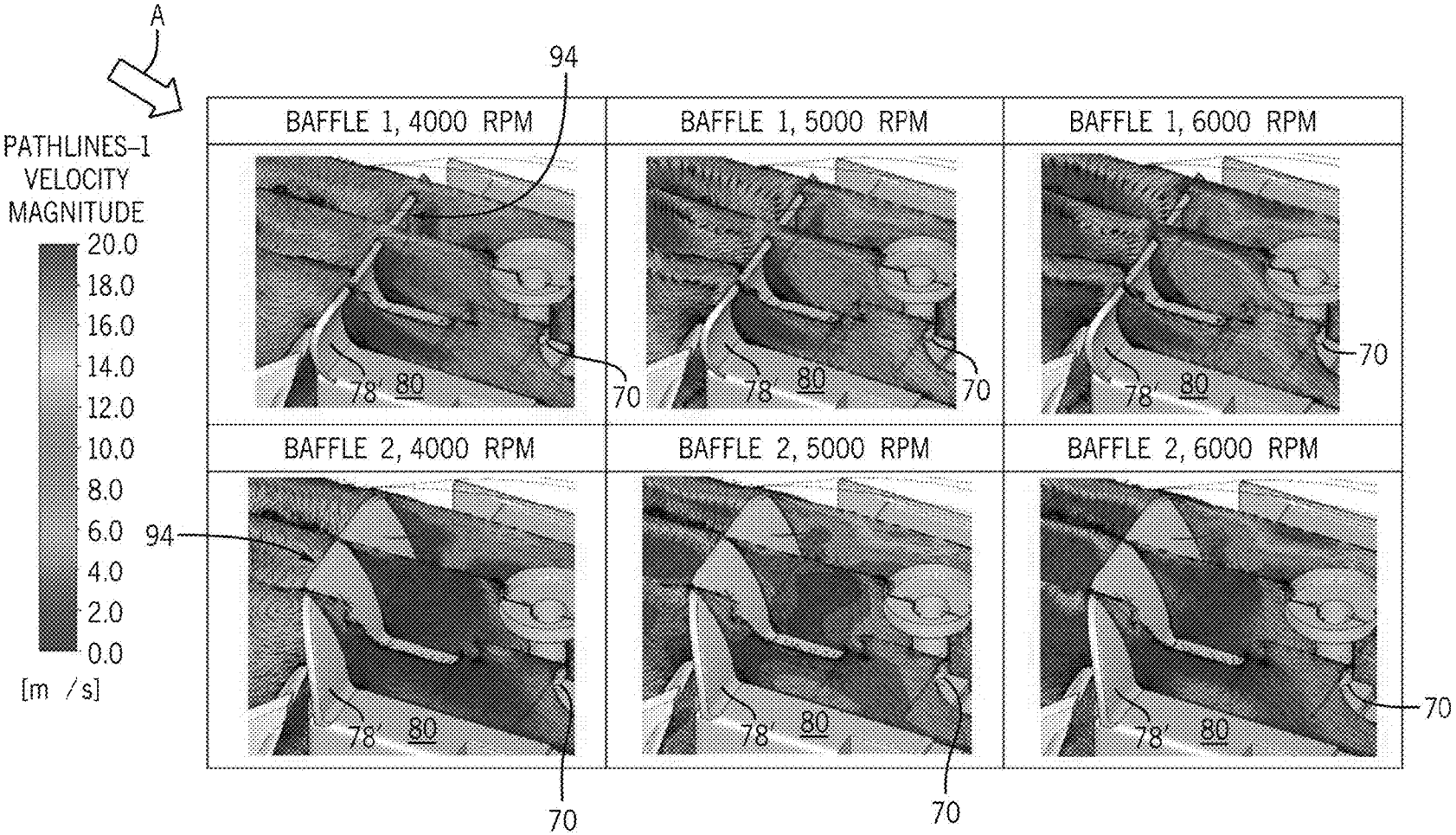
FIG. 13 shows CFD analysis performed on two different baffles for use with the gas valve, each baffle modeled at three different speeds of a forced-air device of the blown air heating system.

Further, as can be seen best in FIG. 10, the baffle 78 extends from the first end 92 proximate the gas valve 66 and curves toward the second end 94, which is located upstream of the first end 92 in relation to the direction of airflow A (see FIG. 2). The present inventors have determined through research and development that curving the baffle 78 opposite the direction of airflow A is particularly effective at reducing the velocity of air at the location of the gas inlet port 70. FIGS. 11 and 12 show the area of the baffle 78 and the gas inlet port 70 in perspective and side views, respectively. In each, the airflow direction is shown by the arrow A. The blown air heating system 10 with baffle 78 was modeled using CFD analysis software, and FIGS. 11 and 12 are screen shots of the airflow velocity resulting from such modeling. Red areas represent areas of highest airflow velocity (at 18-20 m/s), while blue areas represent areas of lowest airflow velocity (at 0-4 m/s). (A key representing all of the colors and airflow velocities is shown in FIG. 13.) It can be seen that airflow velocity upstream of the baffle 78 is significantly higher than airflow velocity downstream of the baffle 78, with the reduction in airflow velocity downstream of the baffle being between about 14-20 m/s.

FIG. 13 shows the above-noted key for the modeled flow velocities, as well as a comparison between two baffle configurations. The baffle configuration in the three lower screen shots is the same as that shown in FIGS. 2 and 7-12. The baffle configuration in the upper three screen shots is similar, in that the baffle 78' extends from the upstream side of the cover 80 over the gas valve 66. However, in the embodiment in the upper three screen shots, the second (distal) end 94' of the baffle 78' is curved with the direction of airflow A instead of being curved against the airflow A, as with the second end 94 of baffle 78. CFD analyses were generated at three different speeds of the forced-air device 18, 4000 RPM, 5000 RPM, and 6000 RPM. At all three speeds, the baffle 78' is able to significantly reduce the airflow velocity directly downstream of the baffle 78'. However, at the gas inlet port 70, the air velocity picks back up slightly. In contrast, the baffle 78 shown in the lower three screen shots is able to reduce air velocity and maintain such lowered velocity at the gas inlet port 70.

Thus, providing a baffle 78 and cover 80 allows the blown air heating system 10 to meet the standard that that gas piping and gas controls not be located within circulating air passageways. The baffle 78 and cover 80 allow the gas valve 66 to be physically located in the airflow path A, but essentially prevented from direct contact with the circulating air. This means that the gas valve 66 can be located close to the longitudinal center line L of the blown air heating system 10, instead of in a separate walled-off enclosure outside of or ancillary to the main housing 12. Locating the gas valve 66 near the longitudinal center line L of the blown air heating system 10 ensures that the unit remains compact. In the present example, as shown in FIG. 2, the gas valve 66 is located directly adjacent the motors, 33, 38 powering the forced-air devices 18, 30, respectively. Further, as is also shown in FIG. 2, the gas valve 66 is located within a projection P along the longitudinal axis L of a circle circumscribing the plurality of blades 36 of the forced-air device 18. Such a location places the gas valve 66 directly in the airflow path A (albeit shielded by the cover 80 and baffle 78) and within the main volume of the housing 12. Note that the gas valve 66 in the present example is located adjacent the circuit board 44. Further, the outlet ports of the gas valve 66, one of which is shown at 74, are perpendicular to the orientation of the gas inlet port 70 and the gas supply conduit 20. However, the location and/or orientation of the gas valve 66 and its components could vary from that shown.

Consent specifications also provide guidelines regarding the temperature of exhaust exiting a blown air heating system. During research and development, the present inventors also discovered that lengthening the burner tube 46 could promote more heat exchange between the relatively hotter air in the burner tube 46 and the relatively cooler air in the space between the heat exchanger 32 and the inside surface 96 of the housing 12, in turn resulting in cooler air exiting the housing 12 via the combustion exhaust port 26. This is because the hot combustion air is forced to travel down the longer burner tube 46, along more of the length of the heat exchanger 32, before reversing direction to exit via the combustion exhaust port 26. Placing a longer burner tube 46 into the interior open space of the heat exchanger 32 is not as simple as merely lengthening the burner tube, as it would eventually hit the inside surface of the tapered heat exchanger 32. The present inventors realized, however, that a burner tube with a smaller diameter would be able to fit further into the interior open space of the heat exchanger 32 than a burner tube with a larger diameter. For example, as shown in FIG. 3, the burner tube 46 of gas burner 28 has a larger diameter and comes close to contacting the inner surface of the heat exchanger 32 at locations 97. In contrast, the burner tube 46' of gas burner 28' has a smaller diameter than that of burner tube 46, and thus can extend further into the interior volume of the heat exchanger 32 without interference with the interior geometry of the heat exchanger 32. In one example, the burner tube 46' is 4 mm less in diameter than the burner tube 46, and the burner tube 46' is 50 mm longer than the burner tube 46.

As noted above, the burner head 53, 53', which includes the portion of the burner deck 48, 48' that is indented and includes the plurality of ports 50, 50', the burner skin 52, 52', and the igniter 58, 58' need to fit within the diameter of the burner tube 46, 46'. A smaller diameter burner tube 46' could not accommodate the same size burner head and igniter, but the same surface area of the burner head was desired in order to maintain the same heat input, which depends on the surface loading (i.e., rated Watt density) of the burner skin material. The present inventors realized that modifying the shape of the burner head could accommodate the igniter 58' and burner head 53' within a burner tube 46' having a smaller diameter.

Returning to FIGS. 5 and 6, in order to accommodate a burner tube 46' having a smaller diameter than that of burner tube 46, while still maintaining the same surface area over burner skin 52' as burner skin 52, the present inventors modified the shape of the burner head from generally circular to that of a kidney shape. For example, as shown in FIG. 6, the ports 50' in the plurality of ports are arranged such that a perimeter 98 thereabout formed tangent to each outermost port in the plurality of ports 50' has a non-circular shape. The non-circular shape has a first dimension D1 and a second dimension D2 perpendicular to the first dimension D1, and D1 is greater than the second dimension D2. The perimeter of the burner skin 52' (FIG. 5) correspondingly has the same non-circular shape as the perimeter 98 formed about the plurality of ports 50', albeit slightly larger to cover the entire burner head 53'.

As shown in FIG. 5, the flange 63' of the igniter 58' has a first dimension D3 and a second dimension D4 perpendicular to the first dimension D3, and the first dimension D3 is greater than the second dimension D4. The first dimension D3 of the flange 63' is parallel to the first dimension D1 of the non-circular shape of the perimeter 98 formed about the plurality of ports 50'. This aligns the igniter 58' as compact as possible with the burner head 53'. In the example shown, the perimeter 98 formed about the plurality of ports 50' has a kidney shape, and a part of the igniter 58' that is on the second face 56' of the burner deck 48' (e.g., the flange 63', body 64', and electrode 62') is located adjacent a concave segment 100 of the kidney shape. Similarly, the perimeter of the burner skin 52' has a kidney shape, and the part of the igniter 58' that is on the second face 56' of the burner deck 48' is located adjacent a concave segment 108 of the kidney shape. Although the non-circular shape of the perimeter 98 about the plurality of ports 50' and the perimeter of the burner skin 52' is described herein as being "kidney-shaped," it could instead be crescent shaped, a circle with a chord extending thereacross, or more angularly shaped, with the igniter 58' located in the concave or cut-out segment of the shape. In other examples, the non-circular shape of the burner head 53' is more angular adjacent the igniter 58' and follows the shape of the flange 63' thereof.

This location of the igniter 58', with its longer dimension D3 orientated parallel to the longer dimension D1 of the kidney shaped perimeter 98 around the plurality of ports 50' (and thus parallel to the longer dimension of the burner skin 52'), locates the igniter 58' compactly next to the burner head 53'. Particularly, it can be seen that a section 102 of a perimeter of the burner skin 52' is semi-circular, and that the body 64' of the igniter 58' is situated within a circle 104 extrapolated from the semi-circular section 102 of the perimeter of the burner skin 52'. In fact, a majority of the part of the igniter 58' that is on the second face 56' of the burner deck 48' is situated within the circle 104 extrapolated from the semi-circular section 102 of the perimeter of the burner skin 52'. Here, at least the electrode 62' and the body 64' of the igniter 58' are situated fully within the circle 104 extrapolated from the semi-circular section 102 of the perimeter of the burner skin 52'. A majority (i.e., greater than 50% of the surface area) of the flange 63' of the igniter 58' is also situated within the circle 104 extrapolated from the semi-circular section 102 of the perimeter of the burner skin 52'.

Further, the circular sections of the burner head 53' are situated within the burner tube 46' in a manner that maximizes burner head surface area while minimizing burner tube diameter. For example, a section 106 (FIG. 6) of the perimeter 98 formed about the plurality of ports 50' is semi-circular and is concentric with a perimeter of the burner tube 46' over at least 200 degrees of each of the perimeters. More particularly, the semi-circular section 106 of the perimeter 98 formed about the plurality of ports 50' is concentric with the perimeter of the burner tube 46' over at least 220 degrees of each of the perimeters. So too is the semi-circular section 102 of the perimeter of the burner skin 52' concentric with the perimeter of the burner tube 46' over at least 200 degrees of each of the perimeters, and more specifically, so too is the semi-circular section 102 of the perimeter of the burner skin 52' concentric with the perimeter of the burner tube 46' over at least 220 degrees of each of the perimeters. This is not necessarily the case for a circular burner head, where the center of the burner head may need to be offset from the center axis of the burner skin in order to accommodate the igniter within the burner tube.

The combined dimensions of the burner head 53' and igniter 58', measured perpendicular to the longitudinal axis L of the blown air heating system 10, are such that the burner tube 46' is able to be reduced in diameter such that the burner tube 46' is able to extend through at least 50% of a length of the heat exchanger 32. This increases the amount of heat exchanged with the circulating air along airflow path A in contrast to the gas burner 28 of FIG. 3, thereby decreasing the temperature of the exhaust gas. Furthermore, the efficiency of the blown air heating system 10 is increased, as more of the heat generated by the gas burner 28' is transferred through forced convection to the circulating air as opposed to being lost with the exhaust. For example, the change in burner tube length represented by the burner tubes 46 and 46' in FIG. 3 resulted in a decrease in exhaust temperature of about 50 degrees Celsius, all other conditions remaining the same. This reduction in exhaust temperature may result in a shorter flue being required, allowing for easier installation.

Note that the burner tubes 46, 46' are both cylindrical along their entire lengths. However, in other embodiments, the burner tubes may be cylindrical along an upstream portion and truncated cones toward their downstream ends. In still other examples, the burner tubes may be made of a plurality of connected flat wall segments that taper toward one another from upstream to downstream. Both examples would allow for the burner tube to extend even further into the tapering heat exchanger.

Note that the baffle 78 and cover 80 on the gas valve 66 can be used with a shorter burner tube 46 and a generally circular burner head 53, as shown in FIG. 2 and described in U.S. Pat. No. 10,718,518, incorporated herein. Alternatively, the baffle 78 and cover 80 could be used with the longer burner tube 46' and kidney-shaped burner head 53' shown in FIG. 3. In another example, the kidney-shaped burner head 53' and longer burner tube 46' are used in a system that does not have the baffle 78 and cover 80 on the gas valve 66.

In the present description, certain terms have been used for brevity, clarity, and understanding. No unnecessary limitations are to be implied therefrom beyond the requirement of the prior art because such terms are used for descriptive purposes only and are intended to be broadly construed. The different components and assemblies described herein may be used or sold separately or in combination with other components and assemblies. Various equivalents, alternatives, and modifications are possible within the scope of the appended claims.

What is claimed is:

1. A blown air heating system comprising:

a housing having an upstream air inlet and a downstream air outlet;

a forced-air device configured to draw air into the housing via the air inlet and force the air out of the housing via the air outlet, wherein the air follows an airflow path from the air inlet to the air outlet;

a gas burner configured to heat the air as it passes through the housing;

a gas valve configured to provide a fuel gas to the gas burner, wherein the gas valve is located between the air inlet and the air outlet and in the airflow path; and a baffle in the airflow path, the baffle being configured to divert the flow of air away from at least part of the gas valve;

wherein the baffle is an extension of a cover that covers and is in intimate contact with a solenoid valve of the gas valve.

2. The blown air heating system of claim 1, wherein the cover is provided over a majority of the gas valve and is in intimate contact with a valve body of the gas valve.

3. The blown air heating system of claim 2, wherein the cover is located at least on an upstream side of the gas valve.

4. The blown air heating system of claim 3, wherein the baffle extends from the cover proximate the upstream side of the gas valve; and wherein the at least part of the gas valve away from which the baffle is configured to divert the flow of air is located downstream of the baffle.

5. The blown air heating system of claim 1, wherein the baffle extends from a first end proximate the cover to a second end proximate an inside surface of the housing.

6. The blown air heating system of claim 1, wherein the housing has a longitudinal axis that extends through the air inlet and the air outlet, and wherein the baffle extends along a majority of a width of the gas valve, the width being defined along a transverse axis perpendicular to the longitudinal axis.

7. The blown air heating system of claim 1, wherein the baffle extends from a first end proximate the cover and curves toward a second end that is located upstream of the first end.

8. The blown air heating system of claim 1, wherein the at least part of the gas valve away from which the baffle is configured to divert the flow of air is an inlet port of the gas valve that is configured to be coupled to a gas supply conduit supplying the fuel gas.

9. The blown air heating system of claim 1, further comprising a motor that powers the forced-air device;

wherein an output shaft of the motor is coaxial with a longitudinal axis of the housing that extends through the air inlet and the air outlet; and wherein the gas valve is located directly adjacent the motor.

10. The blown air heating system of claim 1, wherein the housing has a longitudinal axis that extends through the air inlet and the air outlet;

wherein the forced-air device comprises a plurality of blades; and wherein the gas valve is located within a projection along the longitudinal axis of a circle circumscribing the plurality of blades.

11. A blown air heating system comprising:

a housing having an upstream air inlet and a downstream air outlet, the housing having a longitudinal axis that extends through the air inlet and the air outlet;

a forced-air device having a plurality of blades and being configured to draw air into the housing via the air inlet and force the air out of the housing via the air outlet, wherein the air follows an airflow path from the air inlet to the air outlet;

a gas burner configured to heat the air as it passes through the housing;

a gas valve configured to provide a fuel gas to the gas burner, wherein the gas valve is located within a projection along the longitudinal axis of a circle circumscribing the plurality of blades of the forced-air device; and a baffle in the airflow path, the baffle being configured to divert the flow of air away from at least part of the gas valve;

wherein the baffle is configured such that at least some of the flow of air is not diverted away from another part of the gas valve.

12. The blown air heating system of claim 11, further comprising a cover provided over a majority of the gas valve and in intimate contact with at least one of a solenoid valve and a valve body of the gas valve, wherein the baffle is an extension of the cover.

13. The blown air heating system of claim 11, wherein the baffle extends from a first end proximate the gas valve to a second end proximate an inside surface of the housing.

14. The blown air heating system of claim 11, wherein the baffle extends from a first end proximate the gas valve and curves toward a second end that is located upstream of the first end.

15. The blown air heating system of claim 11, wherein the at least part of the gas valve away from which the baffle is configured to divert the flow of air is an inlet port of the gas valve that is configured to be coupled to a gas supply conduit supplying the fuel gas.

16. A blown air heating system comprising:

a housing having an upstream air inlet and a downstream air outlet, the housing having a longitudinal axis that extends through the air inlet and the air outlet;

a forced-air device configured to draw air into the housing via the air inlet and force the air out of the housing via the air outlet, wherein the air follows an airflow path from the air inlet to the air outlet;

a motor powering the forced-air device, wherein an output shaft of the motor is coaxial with the longitudinal axis of the housing;

a gas burner aligned along the longitudinal axis of the housing and configured to heat the air as it passes through the housing;

a gas valve configured to provide a fuel gas to the gas burner, wherein the gas valve is located directly adjacent the motor; and a baffle in the airflow path, the baffle being configured to divert the flow of air away from at least part of the gas valve in a localized manner such that the baffle diverts the flow of air only immediately adjacent the gas valve.

17. The blown air heating system of claim 16, further comprising a cover provided over a majority of the gas valve and in intimate contact with at least one of a solenoid valve and a valve body of the gas valve, wherein the baffle is an extension of the cover.

18. The blown air heating system of claim 16, wherein the baffle extends from a first end proximate the gas valve to a second end proximate an inside surface of the housing.

19. The blown air heating system of claim 16, wherein the baffle extends from a first end proximate the gas valve and curves toward a second end that is located upstream of the first end.

20. The blown air heating system of claim 16, wherein the at least part of the gas valve away from which the baffle is configured to divert the flow of air is an inlet port of the gas valve that is configured to be coupled to a gas supply conduit supplying the fuel gas.

* * * * *